United States Patent [19]

Harris et al.

[11] Patent Number: 5,046,406

[45] Date of Patent: Sep. 10, 1991

[54] ADJUSTABLE LOUVER ASSEMBLY FOR A ROOM AIR CONDITIONER

[75] Inventors: James E. Harris, Hermitage; Leonard T. Farfaglia, deceased, late of Brentwood, both of Tenn., by Mary M. Farfaglia, legal representative

[73] Assignee: Whirlpool Corporation, Benton Harbor, Mich.

[21] Appl. No.: 522,198

[22] Filed: May 11, 1990

[51] Int. Cl.[5] ..... F24F 7/00

[52] U.S. Cl. ..... 98/40.24; 98/94.2; 98/40.27

[58] Field of Search ..... 48/94.2, 40.24, 40.27, 48/110, 121.2

[56] References Cited

U.S. PATENT DOCUMENTS

| | | | |
|---|---|---|---|
| 2,735,351 | 2/1956 | Abrahamsen . | |
| 2,737,788 | 3/1956 | Buttner . | |
| 2,940,376 | 6/1960 | Lambert | 98/40.24 |
| 3,177,797 | 4/1965 | Kennedy | 98/40.24 |
| 3,257,931 | 6/1966 | Lupton . | |
| 3,306,182 | 2/1967 | Schwartz . | |
| 3,320,871 | 5/1967 | Wegman . | |
| 3,472,149 | 10/1969 | Harrison . | |
| 3,509,613 | 5/1970 | Koenig . | |
| 3,641,913 | 2/1972 | Dennis | 98/40.24 |
| 3,669,873 | 10/1972 | Irvin . | |
| 3,685,427 | 8/1972 | Loyd . | |
| 3,713,376 | 1/1973 | Ring . | |
| 4,345,510 | 8/1982 | Sterett | 98/40.27 |
| 4,492,094 | 1/1985 | Katayama . | |
| 4,621,570 | 11/1986 | Bolton et al. | 98/40.24 |
| 4,633,770 | 1/1987 | Taylor et al. . | |
| 4,702,156 | 10/1987 | Sano | 98/40.24 |
| 4,750,410 | 6/1988 | Parker | 98/40.28 |
| 4,777,870 | 10/1988 | Bolton et al. . | |

FOREIGN PATENT DOCUMENTS

| | | | |
|---|---|---|---|
| 3040730 | 6/1981 | Fed. Rep. of Germany | 98/40.24 |

*Primary Examiner*—Albert J. Makay
*Assistant Examiner*—William C. Doerrler
*Attorney, Agent, or Firm*—Hill, Van Santen, Steadman & Simpson

[57] ABSTRACT

An adjustable louver assembly for a room air conditioner or other air flow conduit outlet having pivotable horizontal and vertical louvers and which is assembled as a modular unit for attachment to or removal from the air conduit. The assembly is comprised of only three pieces, a box-like housing member, a horizontal louver member and a vertical louver member which are assembled together without the need for additional fasteners. The horizontal louvers are pivotable relative to the box-like member and may be positioned in one of a plurality of discrete angular positions.

19 Claims, 4 Drawing Sheets

ADJUSTABLE LOUVER ASSEMBLY FOR A ROOM AIR CONDITIONER

BACKGROUND OF THE INVENTION

The invention is directed to a room air conditioner and more particularly to a room air conditioner having an adjustable, louver air discharge assembly.

Room air conditioners generally have an air inlet and an air outlet at a front side of the air conditioner which faces the interior of the room when the air conditioner is positioned in a window opening or in a through-the-wall sleeve. Usually warm air is drawn in through a central portion of the front panel to pass through a filter and through the evaporator coil to be cooled and then is directed by a blower or fan to an outlet or outlets, also in the front panel. The outlet may be a single opening positioned either along a top or bottom edge of the front panel or may be a single opening positioned at one side or the other of the front panel. Occasionally the air from the blower is directed into a manifold type box or plenum chamber and from that chamber it is allowed to exit through the front of the air conditioner through more than one opening. For example in U.S. Pat. No. 3,472,149, assigned to the assignee of the present invention, air is drawn into the air conditioner unit through a lower front grill portion and is redelivered to the room through a grill portion which extends along the top edge of the air conditioner.

In U.S. Pat. No. 2,737,788, air is drawn in from a front lower grill opening, through a filter and the air is pressurized by a fan mounted in a manifold chamber or plenum from which air is permitted to exit through two spaced grills. In U.S. Pat. No. 4,492,094 air is drawn in through a front grill, is pressurized by a fan and exits through a grill 30 located at a bottom edge of the front panel. FIGS. 1 and 2 of that patent illustrate prior art constructions of top and side return of cooled air to the room.

The use of a manifold plenum chamber or similar structure requires an extra space in the air conditioner thereby reducing the compactness of the air conditioner and adding to bulkiness. Also such a structure requires extra parts and weight, thus increasing the costs and complexity of manufacturing. Oftentimes, particularly when the air outlet is positioned on a single side of the air conditioner, the air is drawn into the air conditioner evaporator coil in an off-center fashion thereby reducing the efficiency of the air conditioner.

Air outlet openings are occasionally provided with directional controls which may be in the form of louvered members. U.S. Pat. No. 3,713,376 discloses the use of a plurality of horizontally louvered discharge members which are mountable into and removable from an air conditioner and which pivot about a vertical axis to provide a range of directional air flows. The individual horizontal louvers, however, are stationary within the members.

U.S. Pat. No. 3,257,931 discloses a louvered air outlet assembly wherein the louvers are pivotable about both a horizontal and vertical axis. The louvers are also powered such that they will continuously rotate during operation so that the chilled air will be directed in a sweep pattern horizontally and vertically.

SUMMARY OF THE INVENTION

It is an object of the present invention to provide an air conditioner that has one or more air outlets at which directional control is available.

It is a further object to provide a room air conditioner outlet that directs exiting air in both a horizontal and vertical sense.

It is a further object to provide a room air conditioner wherein the vertical directing of the exiting air can be selectively changed between a plurality of predefined discrete angles.

It is a further object of the invention to provide a room air conditioner adjustable louver assembly that is modular in format and can be quickly and easily attached to and removed from the air conditioner unit.

It is a further object of the invention to provide a room air conditioner adjustable louver assembly that can be assembled without the use of fasteners.

These and other objects are accomplished by providing a room air conditioner that has separate adjustable louver assemblies in the form of modular box-like units provided at each front panel opening of the air conditioner so that the user can select the desired flow path for the exiting air.

The modular box-like units have compressible pins at a top and bottom end which snap into snap mounts in the air conditioner which permit the modular units to pivot about a vertical axis. The units contain both vertical and horizontal louvers and the horizontal louvers are each pivotable about a horizontal axis such that the air direction passing through the units can be directed through both a vertical and horizontal angular range.

The modular box-like units are constructed of only three individual pieces, a box-like housing member, a horizontal louver member and a vertical louver or rib member. The three pieces are constructed so as to snap together into an interengaged assembly without the use of additional fasteners. The snap connections are sized and arranged to permit only a single orientation between the parts.

The horizontal louver member is comprised of a plurality of horizontal louvers with each of the louvers pivotable about a pivot pin. Adjacent pairs of louvers pivot about a common living hinge and pivot pin. The louvers are all connected together so as to move in tandem, through the use of living hinges.

The vertical louver member comprises a plurality of vertical and horizontal louvers which are fixed relative to the box-like housing when assembled. The pivot pins of the horizontal louvers are sandwiched between the box-like housing and horizontal louver member, when assembled, in grooves formed in those members. Engagement means in the form of ribs and posts are provided between the horizontal louver member and the horizontal louver member to provide discrete positioning points for the horizontal louvers in a plurality of angular positions.

DETAILED DESCRIPTION OF THE PREFERRED EMBODIMENT

Figure 1:
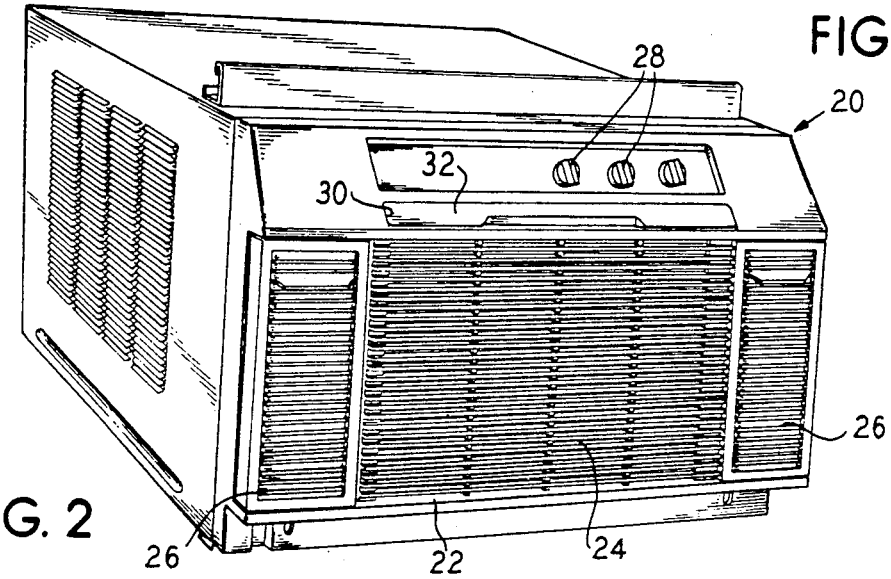
FIG. 1 is a perspective view of a room air conditioner embodying the principles of the present invention.

FIG. 1 illustrates an air conditioner generally at 20 which embodies the principles of the present invention. The air conditioner has a front panel 22 which faces the interior of a room to be cooled when the conditioner unit is placed in an open window or in a through-the-wall sleeve. A central portion 24 of the panel constitues an air inlet grill through which air flows into a portion of the air conditioning unit. The air is returned to the room through a pair of laterally spaced outlet adjustable louver 26. The assemblies 26 are independently controllable the user and contain louvers that are pivotable about both a vertical axis and horizontal axis giving the user a wide range of air flow configurations as described in greater detail below.

A plurality of controls 28 are provided on an angled control panel area above the inlet grill. Positioned above the inlet grill 24 and below the controls is a slot 30 within which is received an air filter element 32. A particular filter arrangement is described in greater detail in copending application Ser. No. 522172 entitled "Dual Side Discharge Air Housing for Room Air Conditioner" (P89,1680) which disclosure is incorporated herein by reference.

Figure 2:
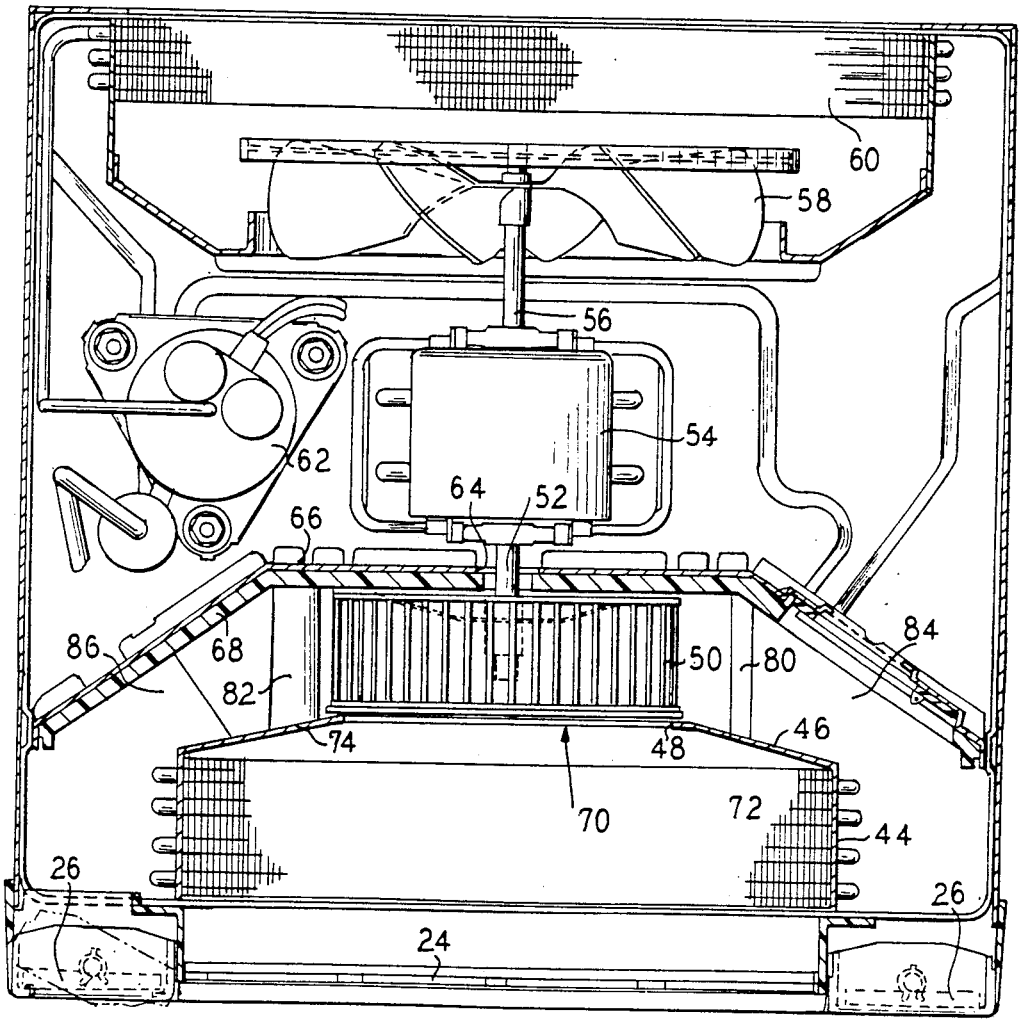
FIG. 2 is a top sectional view of the air conditioner of FIG. 1.

The internal components of the air conditioner are shown in greater detail in FIG. 2 and in this view the symmetrical nature of the air conditioner construction and symmetrical nature of the air flow is quite evident. Directly behind the front inlet grill 24 is located an evaporator 44 which is mounted within a sheet metal housing 46. The housing 46 has a central rear opening 48 which is positioned dirctly in front of an air moving device, preferably a blower wheel 50. The blower wheel 50 is mounted on a forwardly extending drive shaft 52 of an electric motor 54. The motor 54 also has a rearwardly extending drive shaft 56 to which a fan blade 58 is mounted. The drive shafts 52, 56 extend along the center line of the air conditioner. Directly behind the fan blade is the condenser coil 60. A compressor 62 is provided as is known in the art.

The forwardly extending drive shaft 52 extends through an opening 64 in a barrier wall 66 provided between the blower wheel 50 and the motor 52. The barrier wall 66 separates the cold side of the air conditioner (forward of the wall) from the hot side (rearward of the wall). This is desirable to prevent air which has been chilled by passing through the evaporator 44 from being inadvertently discharged through the rear of the air conditioner and to prevent hot air in the condenser portion of the air conditioner from being inadvertently drawn into the cold portion of the air conditioner. A barrier of expanded polystyrene 68 is provided along the barrier wall 66 which provides an insulation against heat transfer. A preferred assembly method and construction of the air conditioner is described in greater detail in copending application Ser. No. 522180 entitled "Assembly Method and Construction for a Room Air Conditioner" (P90,0477) which disclosure is incorporated herein by reference.

As the blower wheel 50 rotates, air is symmetrically drawn into an open center area 70 of the blower wheel 50 from through the opening 48 in the evaporator housing and is caused to leave the blower wheel with radial and tangential flow components. The central location of the opening 48 assures even flow of air through the evaporator coil which enhances the efficiency of heat transfer at the evaporator coil. The expanded polystyrene wall 68 includes forward projecting portions 72, 74 surrounding the blower wheel which form a pair of volute passages and which lead respectively to right and left lateral openings 80, 82. The volute passages and openings 80, 82 are configured and arranged so as to approximately evenly divide the air stream generated by the fan blower 50 and to direct each separate air stream exit through a separate opening. Adjacent and downstream of each opening 80, 82 is a transition air duct 84, 86 which is formed by a portion of the barrier wall 66 which is angled forwardly so as to redirect the air from the blower toward the front of the air conditioner. The opposite side of each of the transition air ducts is formed by a rear angled wall of the evaporator housing 46.

Figure 4:
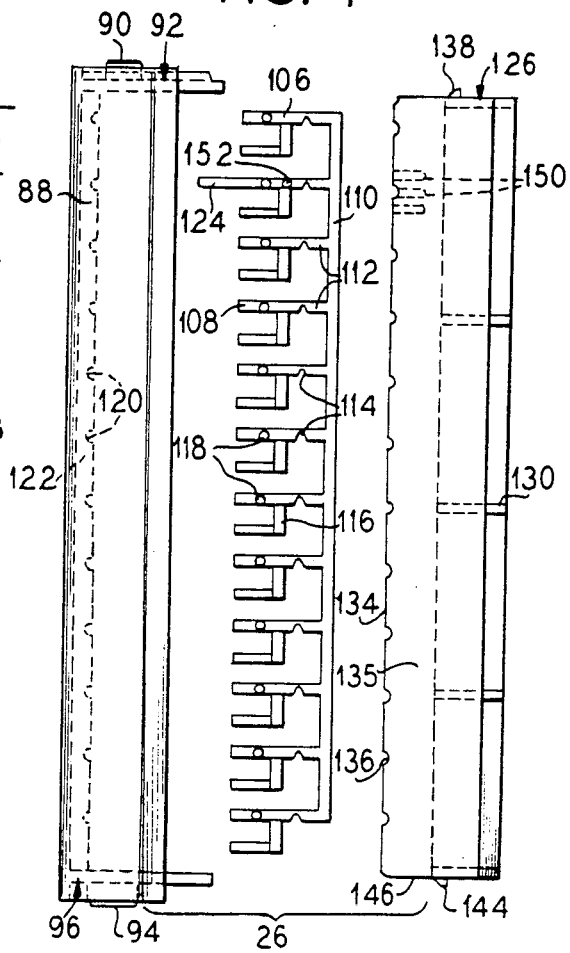
FIG. 4 is an exploded side view of the adjustable louver assembly of FIG. 3.
Figure 5:
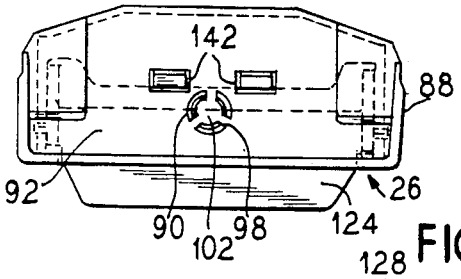
FIG. 5 is a top elevational view of the adjustable louver assembly.
Figure 6:
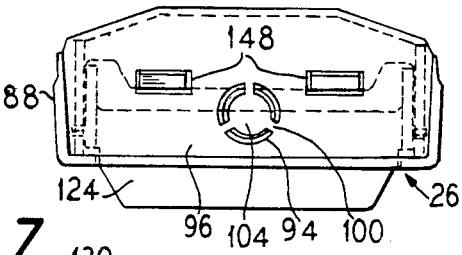
FIG. 6 is a bottom elevational view of the adjustable louver assembly.
Figure 7:
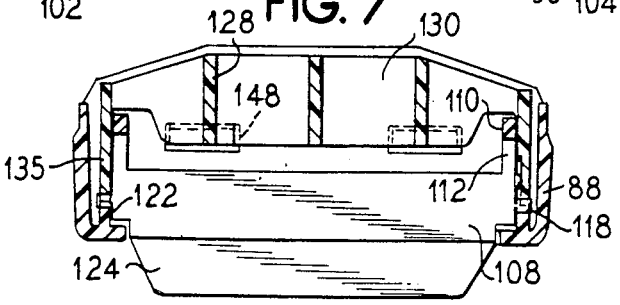
FIG. 7 is a sectional view of the adjustable louver assembly taken generally along the line VII—VII of FIG. 3.
Figure 8:
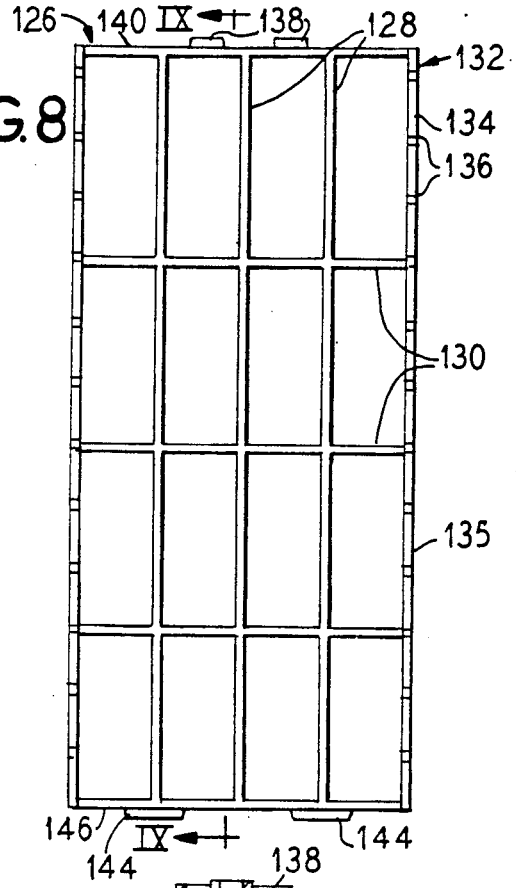
FIG. 8 is an isolated front view of the vertical rib member component of the adjustable louver assembly.
Figure 9:
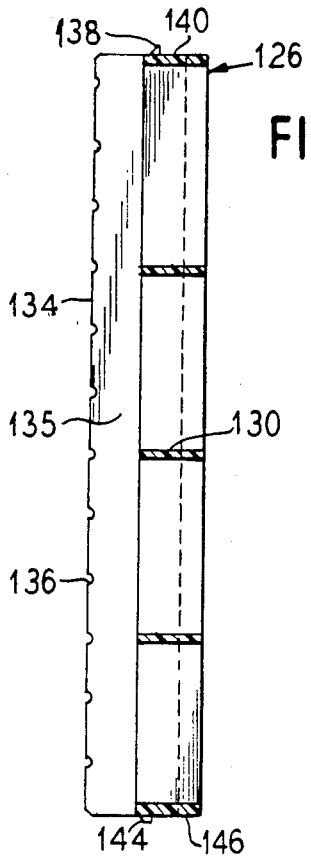
FIG. 9 is an isolated side sectional view of the vertical rib member component of the adjustable louver assembly taken generally along the line IX—IX of FIG. 8.
Figure 10:
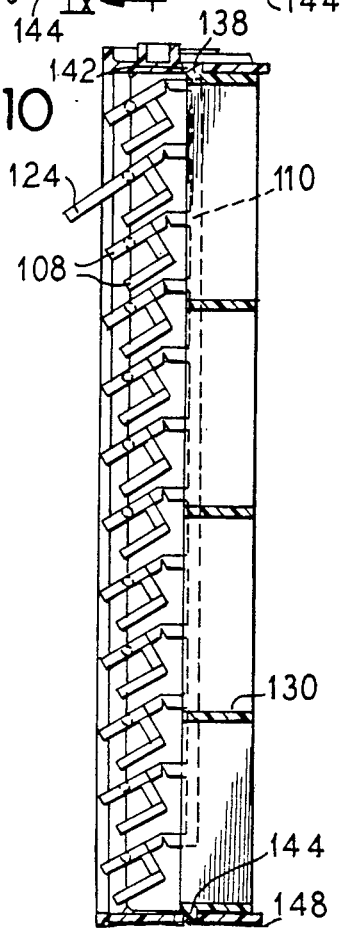
FIG. 10 is an assembled side view of the horizontal louver member and vertical rib member with the louvers directed down.

Positioned at the front of the air conditioner in an outlet of each of the transition air ducts 84, 86 is the adjustable louver assembly 26 which is shown in greater detail in FIGS. 3-16. Each assembly 26 comprises a box-like housing member 88 having a vertically upwardly projecting pin 90 at a top wall 92 and a vertically downwardly projecting pin 94 at a bottom wall 96. The pins 90, 94 preferably are compressible and in a preferred arrangement as best seen in FIGS. 5 and 6, the pins 90, 94 include spaced relieved areas 98, 100 as well as a hollow interior 102, 104 which permit the pins 90, 94 to be compressible.

The pins 90, 94 are received in snap mount sockets (shown and described in co-pending application Ser. No. 522198 (P90,0475) entitled "DUAL LOUVERED SIDE AIR DISCHARGE OPENINGS FOR A ROOM AIR CONDITIONER", which is incorporated herein by reference, and bottom wall of the transition air ducts 84, 86. The sockets also are preferably resilient and may take the form of U-shaped sockets having relieved areas providing the resiliency of the socket. Further, at the open end of the U, the socket legs forming the U may be flared outwardly to provide entering guidance for the pins 90, 94. Thus, the modular units 26 are easily inserted into the front opening of the transition air ducts 84, 86 and are readily held in place through the resilient interaction of the pins 90, 94 and sockets.

By use of the pins and sockets, the units 26 are pivotable about a vertical axis defined by the pins 90, 94.

A second component of the assembly 26 is a horizontal louver member 106 which is comprised of a plurality of horizontal louvers 108. The horizontal louvers are carried on a pair of vertical links 110 that extend the full height of the horizontal louver member 106. Projecting forwardly of the vertical links 110 are a plurality of horizontal arms 112. The horizontal louvers 108 are connected to the horizontal arms 112 and the arms each contain a living hinge 114 which is preferably formed by a V-shaped reduction in thickness of the horizontal arms 112. Each horizontal arm 112 has two separate horizontal louvers 108 connected thereto. Each pair of horizontal louvers 108 connected to a single horizontal arm 112 is interconnected by means of a short vertical leg 116. A laterally projecting pivot pin 118 is provided at each side of the top one of the two interconnected horizontal louvers 108. The pivot pins 118 are received in notches 120 formed in vertical rails 122 of the box-like member 88 when the horizontal louver member 106 is assembled into the box-like member 88. One of the horizontal louvers 124 projects forward further than any of the other horizontal louvers so as to provide a manually graspable handle for flexing and pivoting the horizontal louvers 108 about the pivot pins 118.

Figure 3:
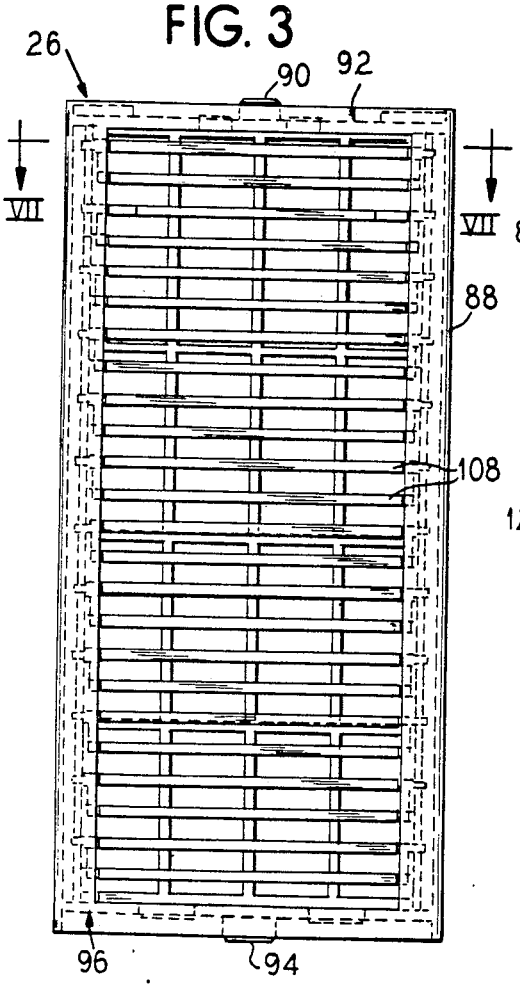
FIG. 3 is a front elevational view of the adjustable louver assembly shown in FIG. 1.

A third component of the adjustable louver assembly 26 is the vertical louver member 126. The vertical louver member is comprised of a rectangular array of vertical 128 and horizontal 130 louvers or ribs. A rectangular frame 132 extends around the perimeter of the vertical louver member 126. A forward edge 134 of the vertical sides 135 of the perimeter 132 contain spaced notches 136 which align with notches 120 formed in the box-like member 88 so as to sandwich the pivot pins 118 of the horizontal louver member 106 therebetween (see FIG. 4). The vertical louver member 126 includes a pair of top tabs 138 which project above a top surface 140 (FIGS. 8 and 9) which are received in apertures 142 formed in the top wall 92 of the box-like member 88. The vertical louver member 126 also includes lower tabs 144 which project from a bottom wall 146 which are received in apertures 148 formed in the bottom wall 96 of the box-like member 88 (FIGS. 3 and 4).

Preferably the box-like member 88 and the vertical louver member 126 are formed of flexible and resilient material such as plastic such that there will be sufficient flex in the top and bottom walls thereof to permit the tabs to be pushed into engagement with the apertures while flexing the top and bottom walls to permit passage of the tabs. Once the tabs are aligned with the appropriate apertures, the resilience of the top and bottom walls will urge the tabs into the apertures to provide locking engagement between the box-like member 88 and the vertical louver member 126 with the horizontal louver member 106 sandwiched therebetween. Thus, the entire assembly is held together without the use of separate fasteners.

Figure 11:
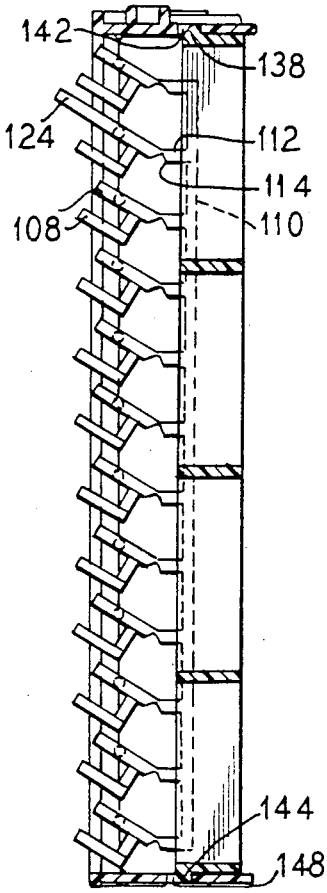
FIG. 11 is an assembled side view of the horizontal louver member and vertical rib member with the louvers directed up.
Figure 12:
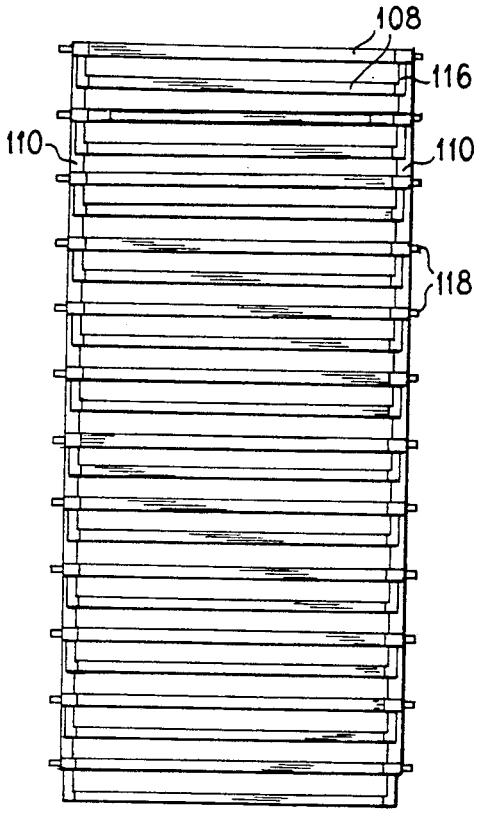
FIG. 12 is an isolated front view of the horizontal louver member component.
Figure 13:
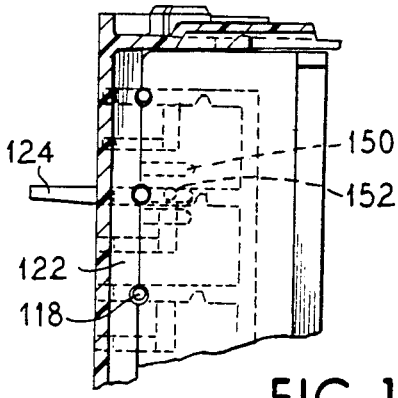
FIG. 13 is a partial side elevational view of the horizontal louver discrete positioning interference arrangement.
Figure 14:
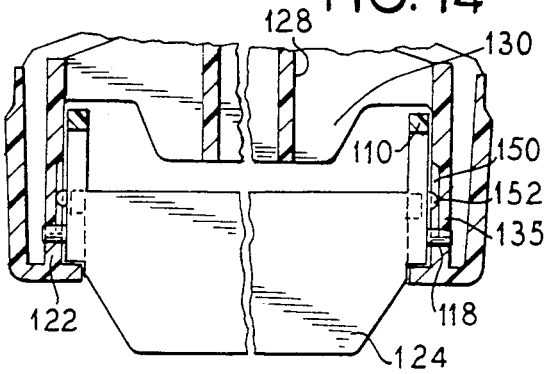
FIG. 14 is a partial top sectional view of the horizontal louver discrete positioning interference arrangement of FIG. 13.

Once the box-like member 88, the horizontal louver member 106 and the vertical louver member 126 are assembled together, the horizontal louvers may be pivoted about their pivot pins 118 by grasping the extension 124 and rotating it down (FIG. 10) or up (FIG. 11). Since all of the louvers 108 are interconnected by means of the vertical links 110, all of the horizontal louvers 108 move in tandem. Since the living hinge 114 is formed by the V-shaped reduction in thickness of the horizontal arms 112, the horizontal louvers 108 are free to move downwardly through a predefined angle corresponding to the angle of the V-shape.

Selective interference means such as a plurality of horizontal grooves 150 and a horizontally projecting post 152 (FIG. 4) may be provided on the vertical louver member 126 and horizontal louver member 106 to provide a plurality of discrete angular positions of the horizontal louvers 108. Thus, as the louvers 108 are pivoted, the post 152 will move in between adjacent grooves 150 to hold the louvers 108 in discrete positions. Although three grooves 150 are illustrated, it will be appreciated that a larger or smaller number of discrete positions may be provided.

Figure 15:
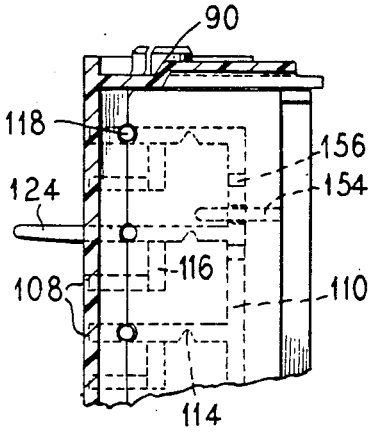
FIG. 15 is a partial side elevational view of an alternative embodiment of the horizontal louver discrete positioning interference arrangement.
Figure 16:
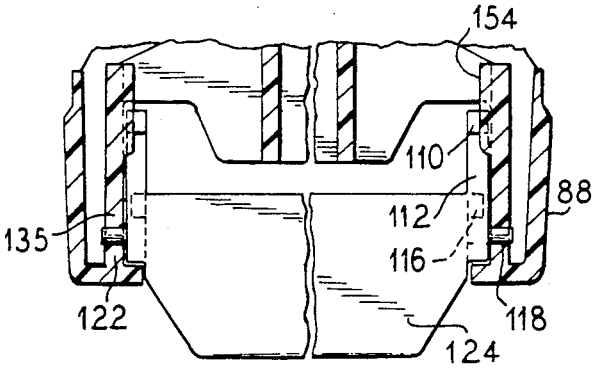
FIG. 16 is a top sectional view of an alternative embodiment of the horizontal louver discrete positioning interference arrangement of FIG. 15.

An alternate arrangement of an interference means is illustrated in FIGS. 15 and 16 wherein a single horizontal rib 154 is provided on each side of the vertical louver member 126 and a series of spaced notches 156 are provided in the lateral sides of the links 110 of the horizontal louver member 106. Again, the interaction and alignment of a projection in a select one of a series of depressions will provide discrete angular positions for the horizontal louvers 108.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An adjustable louver assembly comprising:

a box-like member having walls forming the top, bottom and two lateral sides of said member, an open front and back side, two opposite of said walls each having at least one detent thereon, vertical side rails adjacent to said two lateral side walls, a common face of said rails having a plurality of vertically spaced notches therein;

a horizontal louver member having a plurality of horizontal louvers, at least one vertical link connecting said horizontal louvers, a plurality of pivot pins projecting laterally outwardly from said horizontal louvers about which said horizontal louvers will pivot, said pins receivable in said notches in said box-like member; and a vertical louver member having a plurality of vertical louvers, a top and bottom wall for supporting said vertical louvers, a pair of vertical walls positioned at lateral sides of said horizontal louvers, a common face of said walls having a plurality of vertically spaced notches therein for receiving said pivot pins of said horizontal louver member, two opposite of said walls each having at least one detent thereon engageable with said detents in said box-like member;

wherein said horizontal louver member is sandwiched between said box-like member and said vertical louver member with said pins engaging in both sets of said notches and with said box-like member detents engaging said vertical louver member detents to hold said assembly together without additional fasteners.

2. An adjustable louver assembly according to claim 1, wherein said detents on said box-like member and said vertical louver member comprise apertures on one of said members and tabs on the other of said members.

3. An adjustable louver assembly according to claim 1, wherein said detents on said opposite walls of said box-like member and said vertical louver member are spaced differently on the opposite walls, but spaced similarly between the box-like member and the vertical louver member, such that the box-like member and the vertical louver member are engageable in only a single orientation.

4. An adjustable louver assembly according to claim 1, including means for attaching and removing said assembly to and from an air flow conduit as a single unit.

5. An adjustable louver assembly according to claim 4, wherein said means for attaching and removing said assembly comprises vertical pins projecting from a top and bottom of said louver assembly.

6. An adjustable louver assembly according to claim 1, including means for selectively positioning said horizontal louvers in a select one of a plurality of discrete angular positions.

7. An adjustable louver assembly according to claim 1, wherein said vertical louvers are fixed relative to said box-like member when said box-like member and said vertical louver member are assembled together.

8. An adjustable louver assembly according to claim 1, wherein said box-like member has a vertical pin extending upwardly from a top wall thereof and a vertical pin extending downwardly from a bottom wall thereof about which said assembly may be pivoted.

9. An adjustable louver assembly according to claim 2, wherein said tabs are formed on a top and bottom wall of said vertical louver member and said apertures are formed in a top and bottom wall of said box-like member.

10. An adjustable louver assembly comprising:

a box-like member having walls forming the top, bottom and two lateral sides of said member and having an open front and back side, two opposite walls each having at least one aperture therethrough, vertical side rails adjacent to said two lateral side walls, a rear face of said rails having a plurality of vertically spaced notches therein;

a horizontal louver member having a plurality of horizontal louvers, a pair of laterally spaced vertical links, a plurality of horizontal arms projecting forward from said links for attaching said horizontal louvers to said vertical links, a living hinge formed on each of said arms such that said horizontal louvers will be pivotally movable relative to said arms, a pivot pin projecting laterally outwardly from each of said arms about which said horizontal louvers will pivot, said pins receivable in said notches in said box-like member;

a vertical louver member having a plurality of vertical louvers, a top and bottom wall for supporting said vertical louvers, a pair of vertical walls positioned at lateral sides of said horizontal louvers, a common face of said walls having a plurality of vertically spaced notches therein for receiving said pivot pins of said horizontal louver member, at least one tab projecting from two opposite walls engageable in said apertures in said box-like member; wherein said horizontal louver member is sandwiched in between said box-like member and said vertical louver member with said pins engaging in both sets of said notches and with both sets of tabs engaging in said apertures to hold said assembly together without additional fasteners.

11. An adjustable louver assembly according to claim 10, wherein each arm has two separate horizontal louvers connected thereto.

12. An adjustable louver assembly according to claim 10, including means for attaching and removing said assembly to and from an air flow conduit as a single unit.

13. An adjustable louver assembly according to claim 12, wherein said means for attaching and removing said assembly comprises vertical pins projecting from a top and bottom of said louver assembly.

14. An adjustable louver assembly according to claim 11, wherein said plurality of vertical louvers comprise louvers that are fixed relative to said box-like housing member.

15. An adjustable louver assembly according to claim 11, including means for selectively positioning said horizontal louvers in one of a plurality of discrete angular positions.

16. An adjustable louver assembly comprising:

a box-like member having walls forming the top, bottom and two lateral sides of said member and having an open front and back side, said top and bottom wall each having at least one aperture therethrough, vertical side rails adjacent to said two lateral side walls, a rear face of said rails having a plurality of vertically spaced notches therein;

a horizontal louver member having a plurality of horizontal louvers, a pair of laterally spaced vertical links, a plurality of horizontal arms projecting forward from said links for attaching said horizontal louvers to said vertical links, a living hinge formed on each of said arms such that said horizontal louvers will be pivotally movable relative to said arms, a pivot pin projecting laterally outwardly from each of said arms about which said horizontal louvers will pivot, said pins receivable in said notches in said box-like member;

a vertical louver member having a plurality of vertical louvers, a top and bottom wall for supporting said vertical louvers, at least one tab projecting upwardly from said bottom wall of said vertical louver member, engageable in said aperture in said box-like member top wall, at least one tab projecting downwardly from said top wall of said vertical louver member, engageable in said aperture in said box-like member bottom wall, a pair of vertical walls positioned at lateral sides of said horizontal louvers, a front face of said walls having a plurality of vertically spaced notches therein for receiving said pivot pins of said horizontal louver member;

wherein said horizontal louver member is sandwiched in between said box-like member and said vertical louver member with said pins engaging in both sets of said notches and with both sets of tabs engaging in said apertures to hold said assembly together without additional fasteners.

17. An adjustable louver assembly according to claim 16, wherein said box-like member includes a vertical pin projecting upwardly from said top wall and a vertical pin projecting downwardly from said bottom wall such that said assembly may be pivotally attached to said air conditioner.

18. An adjustable louver assembly according to claim 16, including means for selectively positioning said horizontal louvers in one of a plurality of discrete angular positions.

19. An adjustable louver assembly according to claim 18, wherein said means for selectively positioning said horizontal louvers comprises interference members on said horizontal louver member and said vertical louver member which engage at select angular positions of said horizontal louver to hold said horizontal louver in said select angular positions.

* * * * *